United States Patent [19]

Snedker

[11] 4,377,242

[45] Mar. 22, 1983

[54] ANTI-TAMPERING DEVICES FOR BOTTLES

[75] Inventor: Robert Snedker, Hemel Hempstead, England

[73] Assignee: Seagrams Distillers Limited, Paisley, Scotland

[21] Appl. No.: 242,352

[22] Filed: Mar. 10, 1981

[30] Foreign Application Priority Data

Mar. 12, 1980 [GB] United Kingdom ..... 8008356

[51] Int. Cl.[3] ..... B65D 49/02

[52] U.S. Cl. ..... 215/21; 215/29

[58] Field of Search ..... 215/21, 29, 22, 23, 215/24

[56] References Cited

U.S. PATENT DOCUMENTS

| | | | |
|---|---|---|---|
| 2,009,738 | 7/1935 | Kuenstler . | |
| 2,079,125 | 5/1937 | MacBean . | |
| 3,018,910 | 1/1962 | Unger | 215/22 |
| 3,073,470 | 1/1963 | Greene | 215/22 |
| 3,794,202 | 2/1974 | Unger | 215/22 |
| 4,043,473 | 8/1977 | Webb | 215/21 |
| 4,067,472 | 1/1978 | Cruickshank | 215/22 |
| 4,217,988 | 8/1980 | Mills et al. | 215/21 |
| 4,258,854 | 3/1981 | Wright | 215/21 |
| 4,331,413 | 5/1982 | Hoen | 411/57 |

FOREIGN PATENT DOCUMENTS 1094555 11/1966 United Kingdom .

2057390 4/1981 United Kingdom .

*Primary Examiner*—Donald F. Norton

*Attorney, Agent, or Firm*—Kane, Dalsimer, Kane, Sullivan and Kurucz

[57] ABSTRACT

A device is provided which is non-removably mounted in the mouth of a bottle and which prevents or obstructs the addition of adulterating liquids to the contents of the bottle. The device includes a plastics tubular body 13 having detachably attached to its lower end a non-return valve comprising a ball 14 and a seating ring 15, and a baffle disc 18 formed integrally with the body covers the ball. The body 13 is secured in the bottle mouth by a flanged plastics collet 16 having at its lower end integral resilient tongues 31 which are forced into engagement with a shallow channel 11 on the internal surface of the neck by the act of pressing the body 14 and valve down into the position shown, the valve seating ring 15 having a frusto-conical external surface for this purpose. Upward movement of the body relative to the collet is prevented by a shoulder 22 on the body which comes into abutment with the lower ends of the tongues 31. Liquid can flow past the ball and the baffle to allow the bottle to be emptied but the valve prevents refilling of the bottle. Attempted interference with the ball valve from above can cause the valve to become detached from the body and fall into the bottle to provide visible evidence of tampering.

13 Claims, 5 Drawing Figures

ANTI-TAMPERING DEVICES FOR BOTTLES

FIELD OF THE INVENTION

This invention relates to anti-tampering devices for bottles and more particularly concerns devices intended to prevent or impede the addition of adulterating liquid to the contents of a bottle.

BACKGROUND OF THE INVENTION

Such devices are known, for example in U.S. Pat. Nos. 3,018,910 and 3,794,202, but although to a considerable extent satisfactory, they have disadvantages such as being removable from the bottle without extreme difficulty, and requiring a specially adapted bottle closure to be employed in conjunction with the device.

SUMMARY OF THE INVENTION

The invention seeks to provide an anti-tampering device for bottles in which such disadvantages are alleviated.

According to this invention there is provided an anti-tampering device for insertion in the neck of a bottle, the device comprising a structure which contains a non-return valve adapted to permit the contents of the bottle to be poured out through the device but substantially to prevent flow into the bottle, said structure including an outer part and an inner part axially slidable relative to the outer part, the outer part including a portion which is radially outwardly expandable to grip the internal surface of the neck of the bottle by axial movement of the inner part relative to the outer part in a direction into the bottle.

In preferred arrangements according to the invention the outer part and the inner part have abutment surfaces which, when the expandable portion is so expanded, co-operate to prevent movement of the inner part relative to the outer part in a direction out of the bottle.

According to a further aspect, the invention provides an anti-tampering device for insertion in the neck of a bottle, said device including a non-return valve adapted to permit the contents of the bottle to be poured out through the device but substantially to prevent flow into the bottle, and a portion of the device being connected to the remainder thereof in such manner as to be detachable therefrom by force exerted by an implement inserted into the outlet side of the valve, so as to indicate tampering.

Thus, the presence of the detachable portion loose in a bottle to which the device has been applied is indicative of an attempt to interfere with the valve.

According to a preferred feature of the invention it is the non-return valve which is detachably mounted and can be detached by downward pressure applied to the valve, but it should be understood that the detachable portion could be a part other than the valve. The valve is preferably a ball valve.

BRIEF DESCRIPTION OF THE DRAWINGS

One embodiment of the invention will now be described by way of example with reference to the accompanying drawings in which.

DETAILED DESCRIPTION OF THE PREFERRED EMBODIMENT

Figure 1:
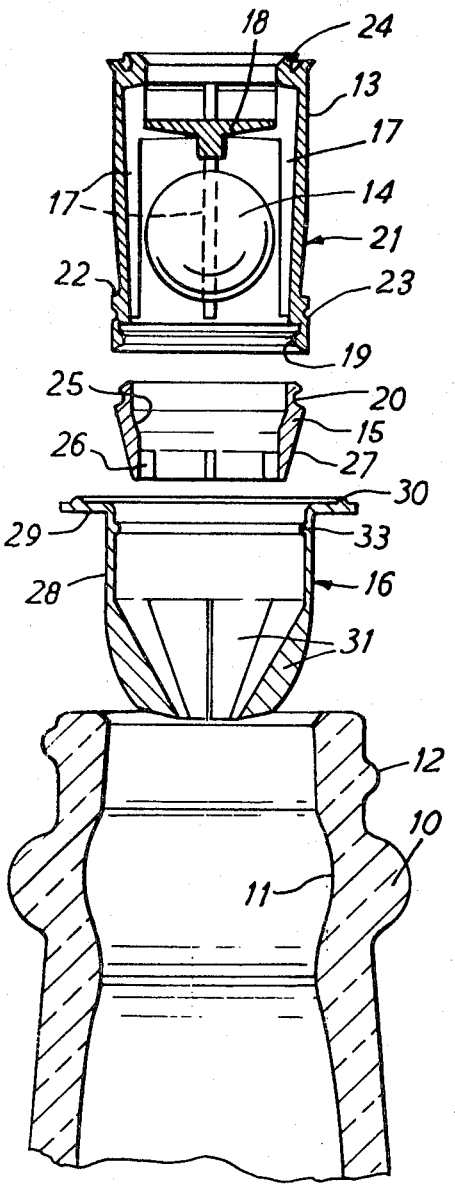
FIG. 1 is an exploded sectional elevation of the components of a device according to the invention, and shows also the neck portion of the bottle to receive the device.

Most bottles are manufactured with an external enlargement on the neck, known as a transfer ring, which is formed during the initial stage of manufacturing the bottle to enable the gob of molten glass from which the bottle is formed to be held securely during its transfer to a hollow mould for blowing into the required form. Subsequently the transfer ring may serve to enable a closure to be held in place on the neck or to retain a security, or so-called pilfer-proof, band. During cooling of the bottle the provision of the transfer ring results in the formation of a shallow groove on the internal surface of the neck at a location opposite the transfer ring. In the arrangement illustrated in the drawings the groove is used to provide an anchorage for an anti-tampering device mounted within the neck of the bottle.

Referring to FIG. 1 of the drawings, the transfer ring is indicated at 10 and the groove at 11. Above the ring a short external screw thread 12 is provided for retaining a closure.

The device comprises a structure including an inner part in the form of a tubular body 13 and an attached valve seating ring 15, and an outer part in the form of a collet 16. This structure contains a non-return valve comprising a valve ball 14 and the co-operating seat 25 on ring 15 as referred to below.

The tubular body is moulded from a tough but resilient plastics material and has four internal lengthwise-extending ribs 17 which serve to guide the movement of the ball 14, and an integral transversely extending circular wall 18 which extends over the ball and acts as a stop to limit upward movement of the ball and as a baffle against interference with the ball. Wall 18 is joined to the tips of the ribs 17. At its lower end the body has a recess to receive the upper end portion of the seating ring 15 and has in the recess an annular retaining rib 19 which engages in a complementary groove 20 formed in the upper end portion of the ring 15. On its radially outer surface the body has a surface 21 which is conically inclined at a small angle and which terminates at an upwardly-facing abutment shoulder 22 near the lower end of the body. Below the shoulder 22 is an annular groove 23. At its upper end, the body has an outwardly inclined upstanding ridge 24 for purposes of sealing the bottle.

The valve seating ring 15 has an internal frustoconical seat 25 for the ball 14 and below the seat has four radially-inwardly projecting ribs 26 which prevent the ball from becoming jammed against the seat and which may also prevent the valve from forming a complete seal, for a reason which is given herein later. The external surface 27 of the ring in its lower portions is frusto conical. The ring is a close fit in the lower end portion of the body.

The collet 16 is moulded from a tough but resilient plastics material. The upper portion 28 of the collet is cylindrical with a radially-outwardly extending flange 29 at its upper end. The flange has an upstanding ridge 30. The lower part of the skirt of the collet is cut axially to form a plurality of tongues 31 having in axial section a conically inclined radially-inner surface and a convexly curved radially-outer surface, and the positioning and shape of the tongues is such that when the flange 29 rests on the upper end of the bottle, radially-outward swinging of the tongues about their upper ends engages them in the shallow groove 11 in the neck of the bottle.

The device is assembled by placing the ball 14 in the body 13, then pressing the ring 15 onto the lower end of the body, and finally inserting the body within the collet so that a rib 33 in the collet engages in the external groove 23 in the lower end portion of the body to secure the components of the device in their desired initial positions.

Figure 2:
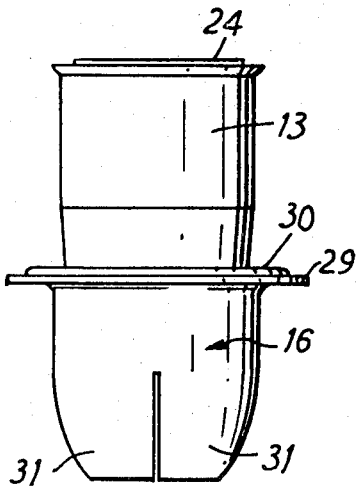
FIG. 2 is an external elevation of the assembled device prior to securing.
Figure 3:
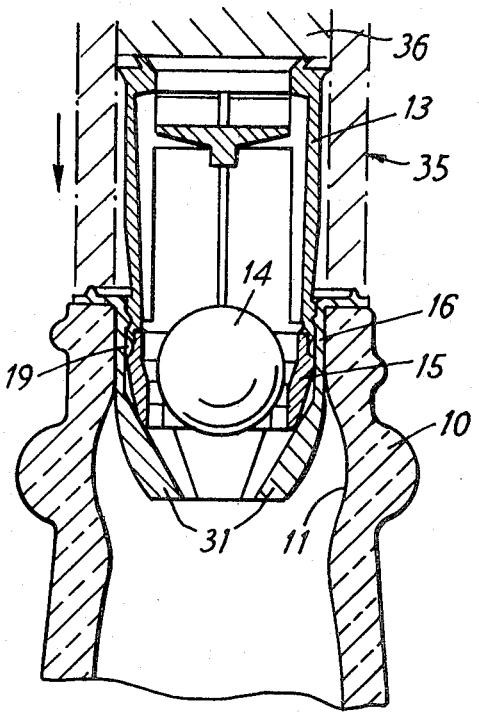
FIG. 3 shows the assembled device in position in the bottle neck and about to be secured.
Figure 4:
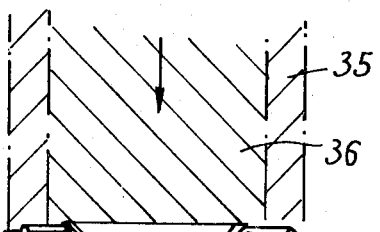
FIG. 4 shows the device secured in the bottle.

The device now has an external appearance as shown in FIG. 3, the tongues of the collet remaining in their initial contracted positions, and this condition is presented to the bottle after the bottle has been filled in manufacture. By means of sleeve 35 (see FIG. 2) which engages only the flange 29 of the collet, the assembly is pressed into the bottle until the flange rests against the top of the bottle. A plunger 36 within the sleeve is then employed (see FIG. 4) to press the body downward until its upper end is substantially flush with the top of the collet. During this downward movement of the body the groove 23 in the body disengages from the ribs 33 in the collet and the frusto-conical external surface 27 of the ring 15 engages the internal frusto-conical surfaces of the tongues 31 and presses the tongues outward into firm engagement with the internal groove 11 in the bottle neck. In the final part of the movement of the body the shoulder 22 moves past the tips of the tongues, so that the collet and the body are both locked against withdrawal from the bottle.

Figure 5:
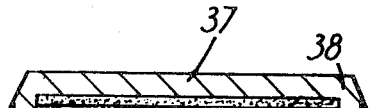
FIG. 5 shows the finished bottle equipped with a screw closure.

Referring now to FIG. 5, a screw-cap 37 with or without a sealing wad 38 is then applied to the bottle and forms a seal with the ridge 30 on the flange of the collet and with the outwardly inclined ridge 24 on the body.

When the screw-cap 37 is removed, the contents of the bottle can be poured out in the ordinary way, the liquid pushing the ball 14 off its seat and flowing past the ball and the baffle 18 when the bottle is tilted. When the bottle is returned to its vertical position the slight leakage permitted by the presence of the ribs 26 engaging the ball enables residual liquid above the ball to seep slowly back past the ball. The valve prevents the addition of adulterating liquid to the remaining contents of the bottle except at a very slow rate and thus substantially hinders and discourages attempts at adulteration. Any substantial force used on the ball or its seat, for example, by an instrument inserted into the outlet side of the valve, causes the seating ring 15 to become detached from the body and causes the ring and the ball to drop into the bottle, where they provide a visible indication of tampering.

It will be understood that the ball must have a density in excess of that of the liquid contents of the bottle.

In cases where the bottle has no transfer ring 10 the axial lengths of the body and collet may be increased if necessary to enable the collet to engage the internal surface of the neck of the bottle at a point where the internal diameter of the neck commences to increase.

Devices of similar design can be used in conjunction with bottles having metal closures of roll-on and roll-on pilfer-proof types.

I claim:

1. An anti-tampering device for insertion in a neck of a bottle, the device comprising a structure which contains a non-return valve adapted to permit the contents of the bottle to be poured out through the device but substantially to prevent flow into the bottle, said structure including an outer part and an inner part axially slidably relative to the outer part, the outer part including a portion which is radially outwardly expandable to grip the internal surface of the neck of the bottle by axial movement of the inner part relative to the outer part in a direction into the bottle, said inner part including a body having inlet and outlet openings, a baffle formed as a single piece with said body and disposed in said outlet opening, a valve seat spaced from said baffle and positioned so as to movably trap a ball valve between said baffle and said valve.

2. A device as claimed in claim 1 wherein the body is tubular and the valve seat is coupled to the tubular body and positioned in said inlet opening.

3. A device as claimed in claim 2, wherein the outer part is a collet in which the tubular body is axially slidably disposed, the collet having a skirt which forms said radially outwardly expandable portion.

4. A device as claimed in claim 1, wherein the outer part and the inner part have abutment surfaces which, when said portion is so expanded, co-operate to prevent movement of the inner part relative to the outer part in a direction out of the bottle.

5. A device as claimed in claim 1, wherein the outer part is made from a resilient material.

6. A device as claimed in claim 1 or 3 wherein the outer part is provided with axial slits to facilitate its expansion.

7. A device as claimed in claim 1, wherein the inner part includes an external generally conical surface which engages the outer part during said relative axial movement in a direction into the bottle thereby progressively expanding said portion of the outer part.

8. A device as claimed in claim 1, wherein the outer part has an annular radially-outwardly projecting flange adapted to abut and form a seal with the neck of the bottle about its mouth.

9. An anti-tampering device for insertion in a neck of a bottle, the device comprising a structure which contains a nonreturn valve adapted to permit the contents of the bottle to be poured out through the device but substantially to prevent flow into the bottle, said structure including an outer part and an inner part axially slidably relative to the outer part, the outer part including a portion which is radially outwardly expandable to grip the internal surface of the neck of the bottle by axial movement of the inner part relative to the outer part in a direction into the bottle, said inner part comprising a tubular body and a detachable portion, the detachable portion being detachable from the tubular body by force exerted by an implement inserted into the outlet side of the device, so as to indicate tampering.

10. A device as claimed in claim 9, wherein the detachable portion forms part of the non-return valve.

11. A device as claimed in claim 10, wherein the valve comprises a seating ring and a ball which under gravity engages a sealing surface on the ring, but which moves into the tubular body when the device is turned upside down, said seating ring being a snap fit in the lower end of the tubular body.

12. A device as claimed in claim 11, wherein the tubular body has axially extending internal ribs serving to maintain the ball generally centrally during movement of the ball into the tubular body.

13. A device as claimed in claim 9, wherein said seating ring includes an external generally conical surface which engages the outer part during said relative axial movement in a direction into the bottle thereby progressively expanding said portion of the outer part.

* * * * *